US010075782B2

(12) United States Patent
Li et al.

(10) Patent No.: US 10,075,782 B2
(45) Date of Patent: Sep. 11, 2018

(54) HEARING AID ADAPTED FOR SUPPRESSION OF WIND NOISE

(71) Applicant: Widex A/S, Lynge (DK)

(72) Inventors: Chunjian Li, Lynge (DK); Mads Jakob Herring Jensen, Lynge (DK); Soeren Christensen, Lynge (DK); Martin Moerkebjerg, Lynge (DK)

(73) Assignee: Widex A/S, Lynge (DK)

( * ) Notice: Subject to any disclaimer, the term of this patent is extended or adjusted under 35 U.S.C. 154(b) by 1222 days.

(21) Appl. No.: 13/644,711

(22) Filed: Oct. 4, 2012

(65) Prior Publication Data

US 2013/0028454 A1 Jan. 31, 2013

Related U.S. Application Data

(63) Continuation-in-part of application No. PCT/EP2011/067358, filed on Oct. 5, 2011, and a (Continued)

(30) Foreign Application Priority Data

Oct. 11, 2010 (DK) ..... 2010 00927

(51) Int. Cl.
*H04R 1/08* (2006.01)
*H04R 25/00* (2006.01)

(52) U.S. Cl.
CPC ..... *H04R 1/086* (2013.01); *H04R 25/65* (2013.01); *H04R 2225/021* (2013.01); *H04R 2410/07* (2013.01)

(58) Field of Classification Search
CPC .. H04R 25/00; H04R 25/65; H04R 2225/021; H04R 2410/07
(Continued)

(56) References Cited

U.S. PATENT DOCUMENTS 5,701,354 A * 12/1997 Komoda ..... H04M 1/19 181/242
7,072,482 B2 * 7/2006 Van Doorn ..... H04R 1/08 381/322
(Continued)

FOREIGN PATENT DOCUMENTS

DE 102007034230 A1 * 1/2009 ..... H04R 25/65
JP 57-46400 8/1980
(Continued)

OTHER PUBLICATIONS

Knowles Electronics "Microphone FG-23329-C05" Apr. 14 2010, pp. 1-2 XP55014544.
(Continued)

*Primary Examiner* — Oyesola C Ojo
(74) *Attorney, Agent, or Firm* — Sughrue Mion, PLLC

(57) ABSTRACT

A hearing aid (100) having a microphone, a signal processing unit, an electrical-acoustical output transducer, a housing (101) and a wind shield cover (102) wherein the housing has a surface with a microphone inlet (112, 113), and the wind shield cover is adapted to be attached to the housing, to cover the microphone inlet, to provide for sound to be guided in a gap between the wind shield cover and the housing, hereby providing for the transmission of sound from the surroundings and to said microphone inlet, wherein a first dimension of a cross-section of the gap is in the range between 0.15 mm and 0.5 mm, and wherein the minimum distance, along the gap, from the microphone inlet and to the opening of the gap, towards the surroundings, is at least 1 mm.

24 Claims, 5 Drawing Sheets

Related U.S. Application Data continuation-in-part of application No. PCT/EP2010/054527, filed on Apr. 6, 2010.

(58) Field of Classification Search
USPC ..... 381/324
See application file for complete search history.

(56) References Cited

U.S. PATENT DOCUMENTS

| | | | | |
|---|---|---|---|---|
| 7,894,621 | B2 * | 2/2011 | Jensen | H04R 1/086 381/322 |
| 2004/0047486 | A1 | 3/2004 | Van Doorn et al. | |
| 2006/0078141 | A1 * | 4/2006 | Jessen | H04R 25/402 381/313 |
| 2007/0053538 | A1 | 3/2007 | Jensen | |
| 2008/0118096 | A1 * | 5/2008 | De Pooter | H04R 1/086 381/359 |
| 2012/0148083 | A1 * | 6/2012 | Knauss | H04R 19/04 381/361 |

FOREIGN PATENT DOCUMENTS

| | | | |
|---|---|---|---|
| JP | 2008-211832 | A | 9/2008 |
| JP | 2013-524658 | A | 6/2013 |
| WO | 2004/103020 | A1 | 11/2004 |
| WO | 2004103020 | A1 | 11/2004 |
| WO | 2011/124250 | A1 | 10/2011 |

OTHER PUBLICATIONS

Office Action for counterpart Japanese Patent Application No. 2013-515929 dated Dec. 3, 2013, with English translation.

Office Action for counterpart Japanese Patent Application No. 2013-503006 dated Dec. 3, 2013, with English translation.

* cited by examiner

HEARING AID ADAPTED FOR SUPPRESSION OF WIND NOISE

RELATED APPLICATIONS

The present application is a continuation-in-part of application No. PCT/EP2010/054527, filed on Apr. 6, 2010, filed in Europe, and published as WO2011124250, and a continuation-in-part of application No. PCT/EP2011/067358, filed on Oct. 5, 2011 in Denmark and published as WO2012049046 A1. The present invention is based on and claims priority from PA201000927, filed on Oct. 11, 2010, in Denmark, the contents of which are incorporated hereinto by reference.

BACKGROUND OF THE INVENTION

1. Field of the Invention

The present invention relates to hearing aids. More specifically the invention relates to a hearing aid with suppression of wind noise.

In the context of the present disclosure, a hearing aid system should be understood as a system for alleviating the hearing loss of a hearing-impaired user. A hearing aid system may be monaural and comprise only one hearing aid or be binaural and comprise two hearing aids.

In the context of the present disclosure, a hearing aid should be understood as a small, microelectronic device designed to be worn behind or in a human ear of a hearing-impaired user. A hearing aid comprises one or more microphones, a microelectronic circuit comprising a signal processor, and an acoustic output transducer. The signal processor is preferably a digital signal processor. The hearing aid is enclosed in a casing suitable for fitting behind or in a human ear.

Several different types of hearing aids exist. One example is Behind-The-Ear (BTE) hearing aids. BTE hearing aids are worn behind the ear. To be more precise a housing containing the major electronics parts is worn behind the ear. An earplug or earpiece for emitting sound to the hearing aid user is worn in the ear, e.g. in the ear canal. In a traditional BTE hearing aid, a sound tube is used because the output transducer, which in hearing aid terminology is normally referred to as the receiver, is located in the housing of the electronics unit. In some modern types of hearing aids a conducting member comprising electrical conductors is used, because the receiver is placed in the earplug in the ear.

In the present context wind noise is defined as the result of pressure fluctuations at the hearing aid microphones due to turbulent airflow. As opposed hereto, acoustic sounds created by winds are not considered as wind noise here, because such sounds are part of the natural environment.

Wind noise in hearing devices is a severe problem. Wind noise may reach magnitudes of 100 dB Sound Pressure Level (SPL) and even more. Users of hearing devices therefore often switch their device off in windy conditions, because acoustical perception with the hearing device in windy surroundings may become worse than without the hearing device.

Depending upon wind speed, direction of the wind with respect to the device, hair length of the individual, mechanical obstructions like hats and other factors, magnitude and spectral content of wind noise vary significantly. With respect to noise, effects and causes reference is made to H. Dillon et al., "The sources of wind noise in hearing aids", IHCON 2000, as well as to I. Roe et al., "Wind noise in hearing aids: Causes and effects", submitted to the Journal of the Acoustical Society of America.

2. The Prior Art

It has been suggested to counteract wind noise by mechanical constructional measures, but these are generally too big or too bulky for implementation in a hearing aid.

In addition such approaches often lead to increased acoustic attenuation of the desired sound.

It is therefore a feature of the present invention to overcome at least these drawbacks and provide a hearing aid with improved wind noise suppression.

SUMMARY OF THE INVENTION

The invention, in a first aspect, provides a hearing aid comprising a microphone, a signal processing unit, an electrical-acoustical output transducer, a housing and a wind shield cover, wherein the housing has a surface with a microphone inlet, and the wind shield cover is adapted to be attached to the housing, whereby to cover the microphone inlet and to provide together with the housing a gap, said gap providing a conduit for the transmission of sound from the surroundings and to said microphone inlet, wherein the spacing between the housing and the wind shield cover is in the range between 0.15 mm and 0.5 mm, and wherein the minimum distance along the gap from the microphone inlet and to an edge of the wind shield cover is larger than 2 mm and less than 3 mm.

This provides a hearing aid with a wind shield and a hearing aid housing that efficiently suppresses wind noise.

The invention, in a second aspect, provides a hearing aid adapted for suppression of wind noise comprising a microphone inlet, a housing, and a sound transmission channel adapted to provide for sound to be guided from the surroundings, through the interior of the housing and to the microphone inlet, wherein a first dimension of a cross-section of the sound transmission channel is in the range between 0.15 mm and 0.5 mm, a second dimension of the cross-section of the sound transmission channel is at least 2 mm, and the length of the sound transmission channel is larger than 2 mm and less than 3 mm.

This provides a hearing aid that is specifically adapted for suppression of wind noise and miniaturization.

The invention, in a third aspect, provides a hearing aid comprising a microphone, a signal processing unit, an electrical-acoustical output transducer, a housing and a wind shield cover, wherein the housing has a surface with a microphone inlet, and the wind shield cover is adapted to be attached to the housing, to cover the microphone inlet, to provide together with the housing a gap, the gap providing a conduit for the transmission of sound from the surroundings and to said microphone inlet, wherein the spacing between the housing and the wind shield cover is in the range between 0.15 mm and 0.5 mm, and wherein the minimum distance along the gap from the microphone inlet and to an edge of the wind shield cover, is at least 3 mm.

The invention, in a fourth aspect, provides a hearing aid adapted for suppression of wind noise comprising a microphone inlet, and a sound transmission channel adapted to provide for sound to be guided from the surroundings and to the microphone inlet, wherein a first dimension of a cross-section of the sound transmission channel is in the range between 0.15 mm and 0.5 mm, and a second dimension of a cross-section of the sound transmission channel, is at least 3 mm, and the length of the sound transmission channel is at least 3 mm.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION OF THE INVENTION

Figure 1:
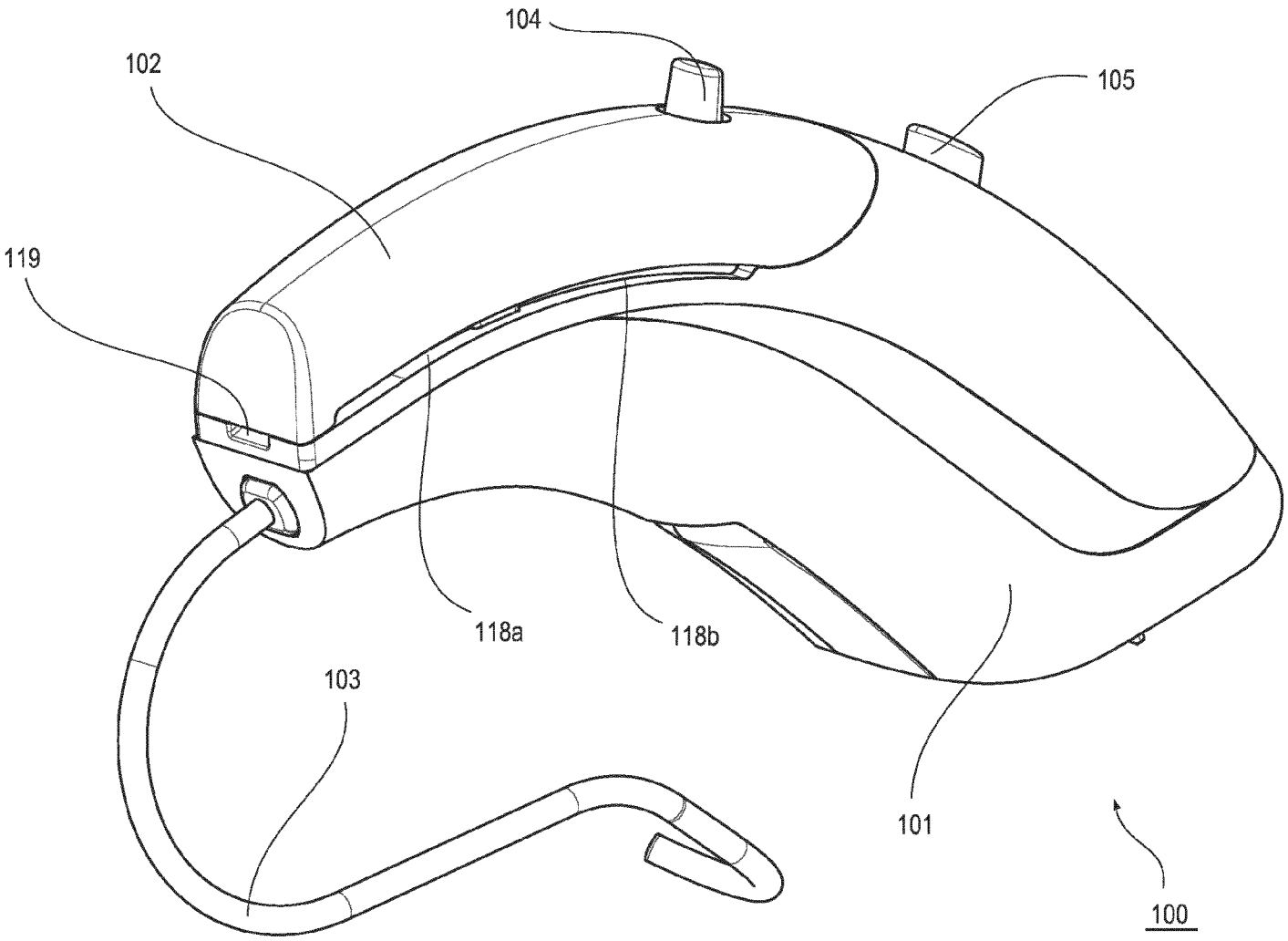
FIG. 1 illustrates a perspective view of selected parts of a hearing aid according to an embodiment of the invention.

It has been found that suppression of wind noise, over a wide band of frequencies, can be significantly improved for a hearing aid according to the various aspects of the invention.

It has been found that the ratio of the wind noise suppression relative to the acoustic attenuation can be improved by providing in the hearing aid a sound transmission channel for sound to be guided from the surroundings and to a microphone inlet, wherein the air flow in the sound transmission channel is made laminar before reaching the microphone inlet.

It has further been found that for a hearing aid according to the various aspects of the invention the ratio of the wind noise suppression relative to the acoustic attenuation can be improved by selecting appropriately the length of the sound transmission channel.

It has been found that the design of the cross-section of the sound transmission channel can further optimize the ratio of the wind noise suppression relative to the acoustic attenuation.

Now consider a small diameter tube that is adapted to convey sound from the surroundings and to a microphone inlet, where the tube is designed such that, for normally occurring conditions (i.e. wind speeds), a turbulent flow initiated at an opening of the tube cannot be maintained in the tube and will develop into a laminar flow after a distance shorter than the tube length. Such a tube will prevent the onset of turbulent flow around the microphone inlet, which obviously is beneficial, but the turbulent flow around the opening of the tube still induces pressure fluctuations that are efficiently conveyed, by the tube, to the microphone inlets, hereby picking up wind noise.

Now consider a tube with a significantly larger diameter, where the flow in the tube will be turbulent for normally occurring conditions. Such a tube cannot prevent the onset of turbulence around the microphone inlet which is obviously not beneficial, but the pressure fluctuations developed by the turbulent flow around the tube opening will not be efficiently guided to the microphone inlet and instead tend to dissipate.

Therefore the first small diameter tube is well suited for suppression of wind noise created by turbulent winds flowing directly into the tube, whereas the second, larger diameter tube is well suited for avoiding picking up wind noise induced by a turbulent wind flow at the opening of the tube.

Now consider a setup with two parallel plates spaced to form a gap adapted to convey sound from the surroundings and to a microphone inlet positioned inside the gap between the plates and at the center of one of the plates. Such a setup is obviously well suited for suppression of wind noise created by winds flowing perpendicular to the plane of the plates. The plates may also be well suited for suppression of wind noise created by winds flowing along the plane of the plates, if the dimensions are carefully chosen as stated below.

In case the in-plane wind flow is perpendicular to the edges of the plates this requires that firstly the spacing between the plates is sufficiently small such that a turbulent wind flow (for most normally occurring wind speeds) is not maintained in the gap between the plates and that secondly the lateral extent of the plates (and hereby the propagation distance) is sufficiently large such that the turbulent flow at the plate edges has transformed into a laminar flow at the microphone inlet.

It has been found that the ratio of the wind noise suppression relative to the acoustic attenuation for wind flowing in-plane and parallel with the edges of the plates can be improved by increasing the lateral extent of the plates (and hereby also the propagation distance), because the propagation of the turbulence induced pressure fluctuations is well modeled by a near-field model while the propagation of the main part of the desired sounds from the surroundings is well modeled by a far-field model, and therefore the attenuation of the turbulence induced pressure fluctuations will depend strongly on the propagated distance.

It has been found that the acoustic attenuation of sound propagating under a wind shield or generally in a sound transmission channel according to various embodiments of the invention starts to increase significantly when the plate spacing becomes smaller than 0.15 mm. On the other hand it is well known that the propagation distance required for transition of a turbulent flow into a laminar flow depends on the value of the plate spacing squared. The preferred value of the plate spacing is therefore selected from a range where the acoustic attenuation is limited and where the flow for most normally occurring wind speeds is quickly transformed into a laminar flow.

For a flow between two parallel plates the distance L required for transforming a turbulent flow into a laminar flow is given by the following expression:

$$L=h^2v/(8\upsilon)$$

where h is the spacing between the two parallel plates, v is the speed of the flow (i.e. the wind speed in the present context) and υ is the kinematic viscosity of air.

It has been found that the acoustic attenuation of sound propagating in a gap according to the various embodiments of the invention remains small for propagation distances up to at least 10 mm. It is therefore a specific advantage of a hearing aid according to the invention that wind noise suppression can be increased without a decrease in hearing aid sensitivity.

Reference is first made to FIG. 1, which illustrates selected parts of a hearing aid 100 according to a first embodiment of the invention. The hearing aid 100 consists of a housing part 101, a wind shield cover 102, a connector part 103 and an earpiece (not shown). The housing part 101 includes two microphones, a microelectronic circuit comprising a signal processor, an acoustic output transducer, a toggle switch 104 and a push-button 105. The connector part 103 is designed for conveying an acoustic signal from the output transducer to the earpiece and towards the eardrum of a user wearing the hearing aid. The wind shield cover is adapted for protecting the microphone inlets from dirt and moisture and for suppressing wind noise. The hearing aid housing 101 and the wind shield cover 102 are adapted for forming side openings 118*a* and 118*b* (similar openings are formed at the opposite side of the hearing aid housing) when the wind shield cover is attached to the hearing aid housing. The openings are adapted for allowing sound to be transmitted into the gap between the hearing aid housing and the wind shield cover. The front indent 119 is adapted for allowing removal of the wind shield cover from the hearing aid housing a simple tool.

Figure 2:
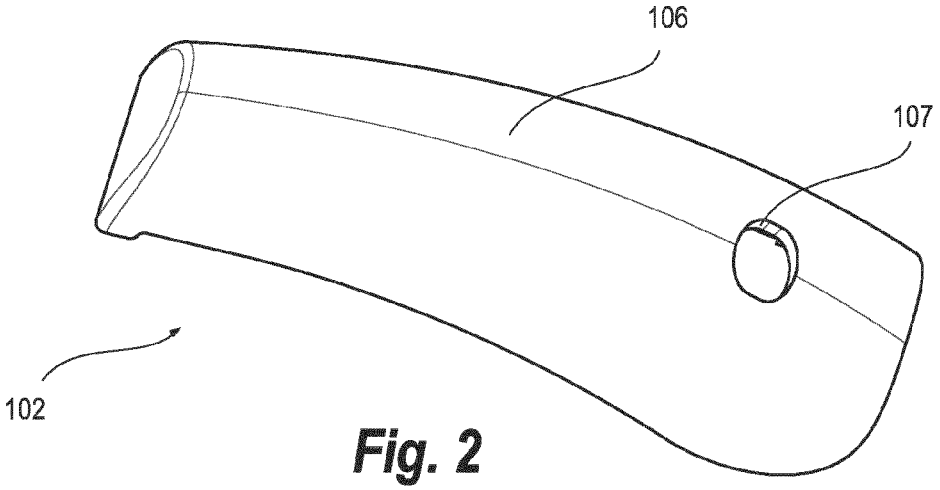
FIG. 2 illustrates, from a first perspective, a wind shield cover according to the embodiment of FIG. 1.

Reference is now made to FIG. 2, which illustrates, from a first perspective, the wind shield cover 102 according to the first embodiment of the invention. The wind shield cover has a convex side 106 that is designed to face away from the hearing aid housing (not shown) and a hole 107 adapted for allowing user access to the toggle switch 104 in the hearing aid housing.

Figure 3:
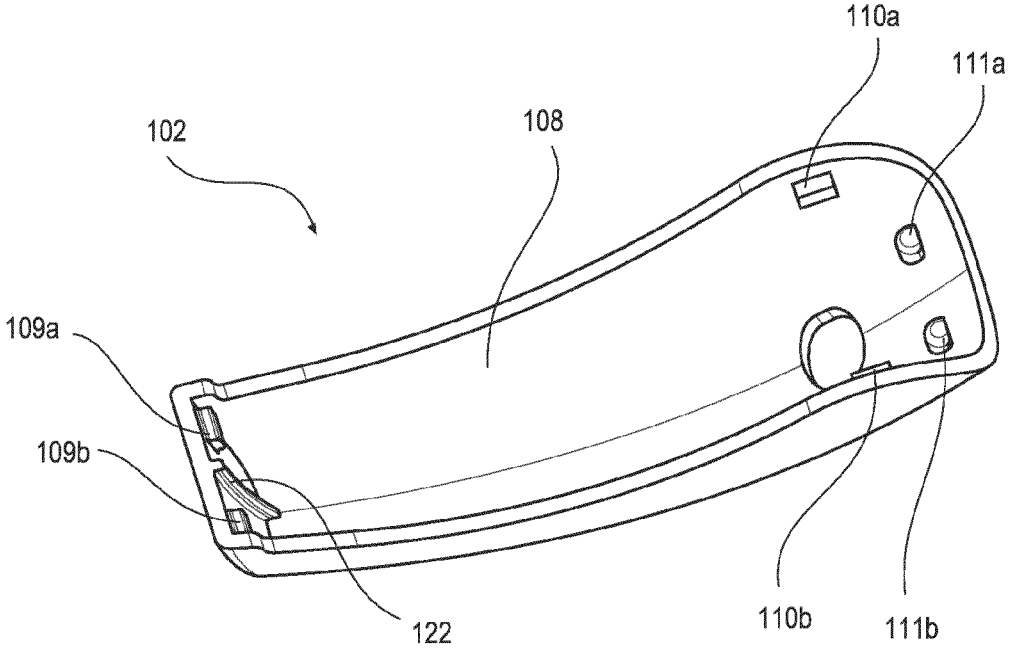
FIG. 3 illustrates, from a second perspective, the wind shield cover according to the embodiment of FIG. 1.

Reference is now made to FIG. 3, which illustrates, from a second perspective, the wind shield cover 102 according to the first embodiment of the invention. The wind shield cover has a concave side 108 that is designed to face towards the hearing aid housing (not shown). The concave side 108 has projections 109*a*, 109*b*, 110*a* and 110*b* adapted for snap locking of the wind shield cover onto the hearing aid housing. The concave side further has column like structures 111*a* and 111*b* and protrusion 122 adapted for assisting in guiding the wind shield into correct position when mounting the wind shield cover onto the hearing aid housing.

Figure 4:
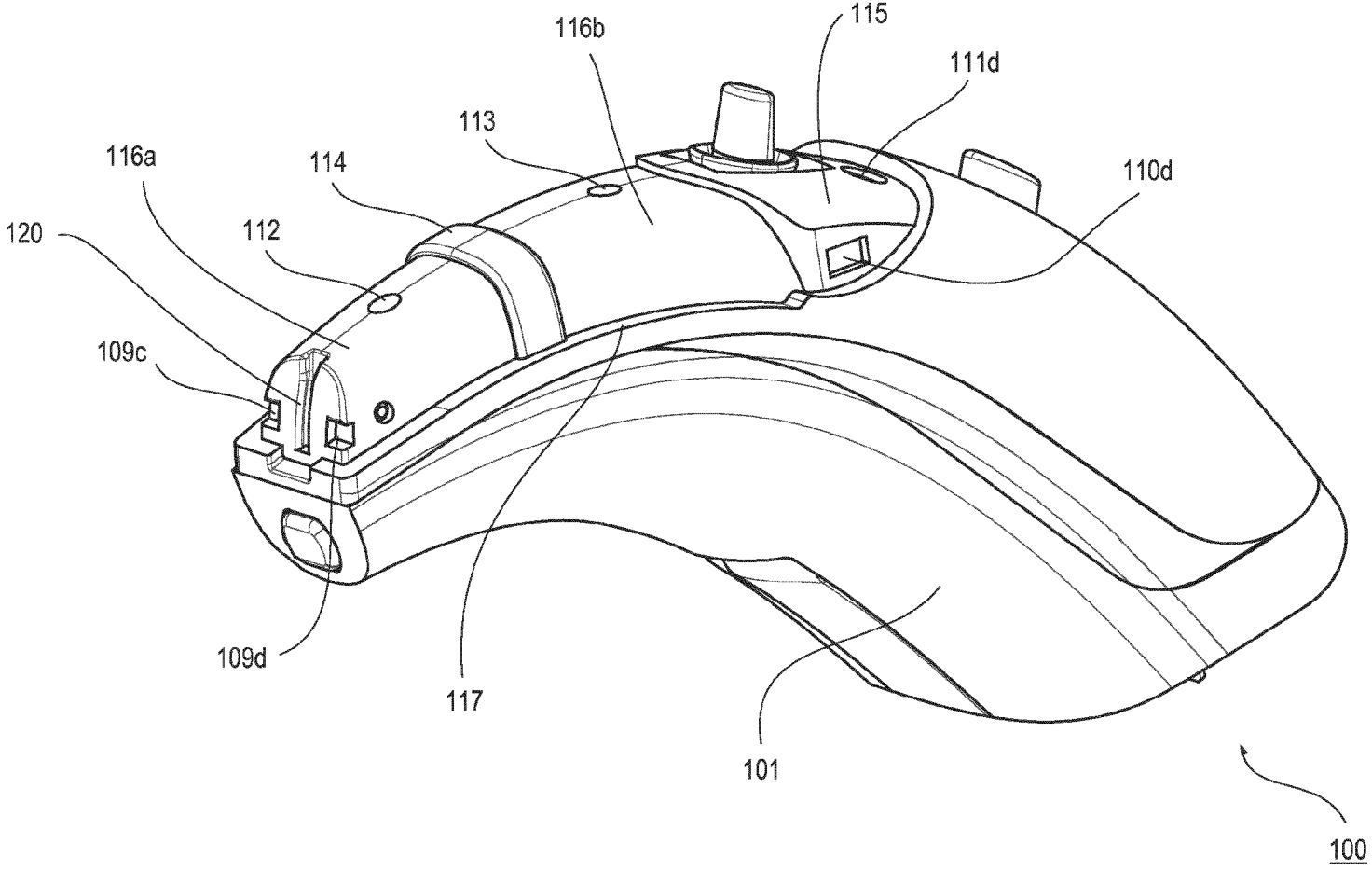
FIG. 4 illustrates, a perspective view of the hearing aid housing according to the embodiment of FIG. 1.

Reference is now made to FIG. 4, which illustrates schematically the hearing aid housing 101 according to the first embodiment of the invention. The housing 101 has two microphone inlets 112 and 113, four indents 109*c*, 109*d* and 110*d* (one is not shown) that are adapted for snap fit connection with the corresponding projections 109*a*, 109*b*, 110*a* and 110*b* in the wind shield. The hearing aid housing has holes 111*d* (one is not shown) adapted for receiving the column like structures 111*a* and 111*b* in the wind shield cover and a rectangular indent 120 for receiving the wind shield cover protrusion 122. A band like projection 114 positioned between the microphone inlets and another projecting structure 115 work together to ensure a uniform and well defined gap distance between the concave side 108 of the wind shield and the surface areas 116*a* and 116*b* of the hearing aid housing 101. The projecting structure 115 surrounds the toggle switch 104 and incorporates the indents 110*d* (one is not shown) and holes 111*d* (one is not shown). The surface areas 116*a* and 116*b* define the surfaces along which sound will propagate from the ambient surroundings and towards the microphone inlets 112 and 113. The surface areas 116*a* and 116*b* and the projection structures 114 and 115 are surrounded by a rim 117. The rim is adapted such that the openings 118*a* and 118*b* are formed when the wind shield cover is snap fitted onto the hearing aid housing. The indent 120 ensures that the wind shield cover can be easily removed from the hearing aid housing a tool.

The gap distance between the wind shield cover 102 and the surface areas 116*a* and 116*b* of the hearing aid housing is 0.3 mm.

In variations of the first embodiment of the invention the gap distance between the wind shield cover 102 and the surface areas 116*a* and 116*b* of the hearing aid housing is in the range between 0.15 and 0.5 mm, preferably in the range between 0.20 mm and 0.35 mm. Such a gap distance entails that the air flow beneath the wind shield cover after a short propagated distance is substantially laminar, for most normally occurring wind speeds, and that the acoustic attenuation of the sound as a result of the propagation under the wind shield cover is small.

According to the first embodiment of the invention the minimum distance, along the gap (i.e. running in the gap between the wind shield cover 102 and the hearing aid housing 101), from the openings 118*a* and 118*b* to the corresponding microphone inlets 112 and 113 respectively is 2 mm. In the present context the term: "minimum distance, along the gap" shall be interpreted as the shortest distance between an edge of a microphone inlet and a corresponding opening, towards the surroundings, defined by an edge of the wind shield cover and the hearing aid housing.

In variations of the first embodiment of the invention the minimum distance, along the gap is at least 1 mm, at least 2 mm, or in the range between 1 mm and 3 mm (i.e. larger than 1 mm and smaller than 3 mm). It has surprisingly been found that even such relatively limited gap distances provide a measurable and significant improvement of wind noise reduction.

It is advantageous to increase the minimum distance along the gap for several reasons. Firstly it entails that the air flow in the gap is laminar when reaching the microphone inlet for stronger wind speeds, as already mentioned in the preceding section. Secondly the attenuation of the turbulence induced pressure fluctuations, formed along the edge of the wind shield, increases strongly with distance. Finally the pressure fluctuations induced by uncorrelated turbulent whirls formed along the edge of the wind shield will at least partly cancel each other at the microphone inlet, and the efficiency of said cancelling generally increases with the minimum distance along the gap, because the cancelling of two uncorrelated turbulent whirls is optimal when the distances between the microphone inlet and the respective whirls are identical. On the other hand it has been found that embodiments with minimum distances down to 1 mm provide a good compromise with respect to high wind noise suppression and flat frequency microphone response. In a specific variation of the first embodiment of the invention the gap distance is 0.3 mm and the minimum distance along the gap is 1.5 mm. According to the first embodiment of the invention the widths of the openings 118*a* and 118*b* both measure 5 mm.

In a variation of the first embodiment of the invention separate openings 118*a* and 118*b* are not provided. Instead the full length of the wind shield defines the width of both the openings.

In further variations of the first embodiment of the invention the widths of the openings 118*a* and 118*b* measure at least 2 mm, at least 3 mm, or at least 5 mm. It is advantageous to have wide openings in order to avoid that pressure fluctuations induced by a turbulent flow around the openings will be efficiently guided to the microphone inlet and instead will tend to dissipate. On the other hand it has been found that embodiments with openings having a width in the range between say 2 and 5 mm provide a good compromise with respect to high wind noise suppression and flat frequency microphone response.

According to a further variation of the first embodiment of the invention the minimum distance, along the gap, between the openings 118*a* and 118*b* and the edges of the corresponding microphone inlets 112 and 113, varies because of the variation of the hearing aid housing width.

In a variation of the first embodiment of the invention the width of the openings 118*a* and 118*b* depends on the variation of the minimum distance such that the ratio of the width of the opening relative to the length of said minimum distance is kept substantially constant.

Figure 5:
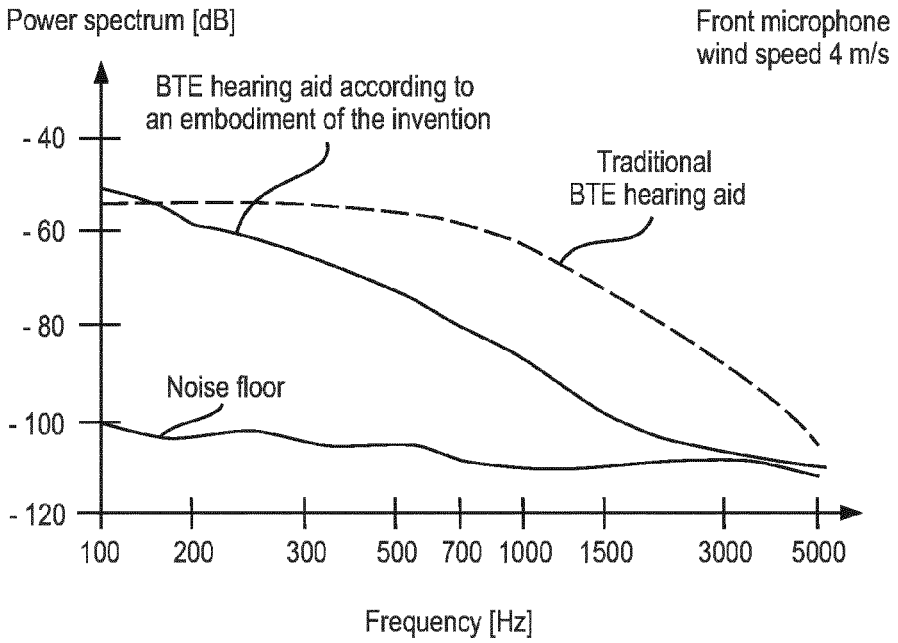
FIG. 5 illustrates a typical measurement of the power spectrum as a function of frequency for a front microphone in a traditional BTE hearing aid and in a BTE hearing aid having a wind shield cover according to an embodiment of the invention, when exposed to wind with a speed of 4 m/s.

Reference is now made to FIG. 5, which illustrates the results of typical measurements of the power spectrum as a function of frequency for a traditional BTE hearing aid and a BTE hearing aid having a wind shield cover according to an embodiment of the invention. The measurements were carried out while the hearing aids were exposed to wind with a speed of 4 m/s. Both hearing aids were equipped with two microphones and the power spectrum was obtained using the front microphone in the two hearing aids. The figure clearly illustrates that a significant reduction in wind noise can be obtained with a hearing aid having a wind shield cover according to the invention.

Figure 6:
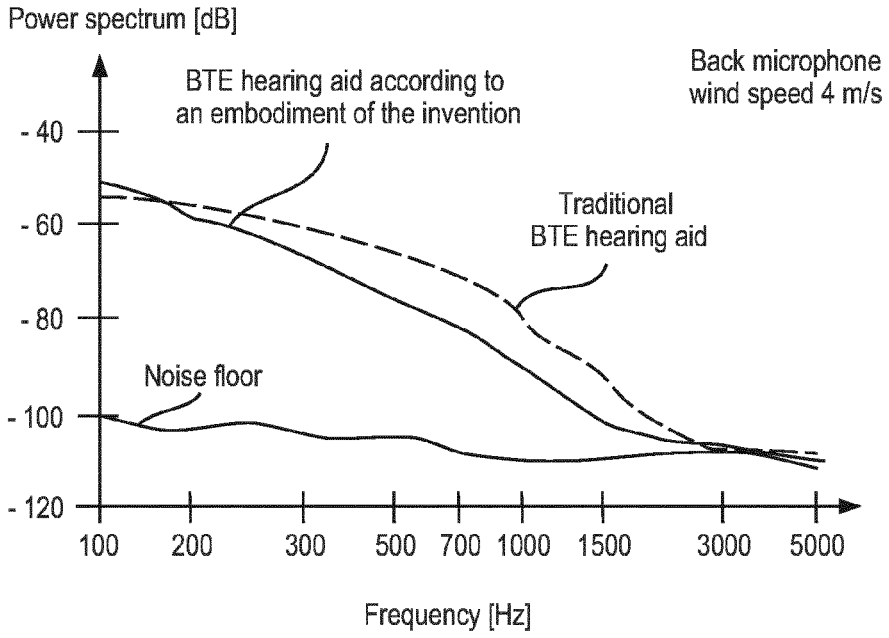
FIG. 6 illustrates a typical measurement of the power spectrum as a function of frequency for a back microphone in a traditional BTE hearing aid and in a BTE hearing aid having a wind shield cover according to an embodiment of the invention, when exposed to wind with a speed of 4 m/s.

Reference is now made to FIG. 6, which illustrates the results of typical measurements similar to those described with reference to FIG. 5, except for the fact that the back microphone in the two hearing aids has been used to obtain the power spectrum. The figure clearly illustrates that the magnitude of the achievable wind noise reduction depends on the positioning of the microphone. The FIGS. 5 and 6 also illustrate that a typical power spectrum for the BTE hearing aid according to the invention is relatively insensitive to the microphone positioning, while this is not the case for the traditional BTE hearing aid.

Figure 7:
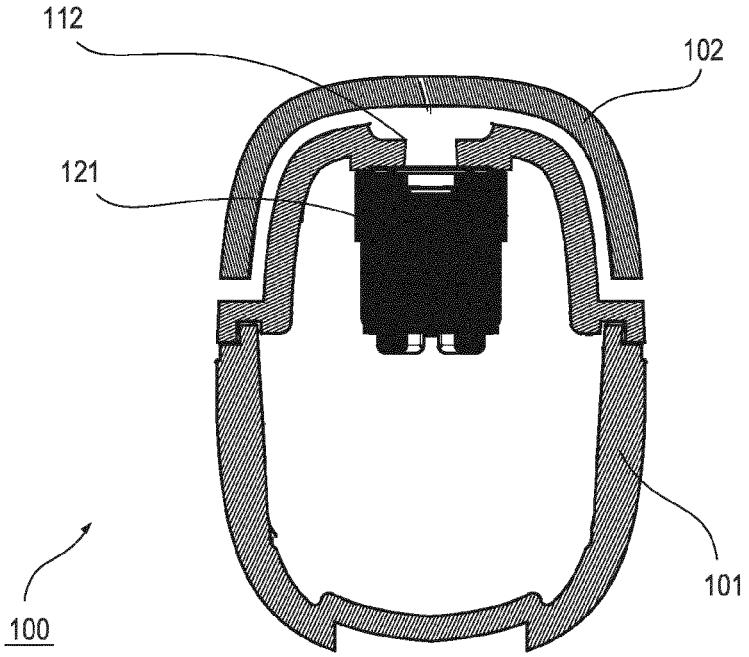
FIG. 7 illustrates highly schematically a cross-section of a hearing aid according to the embodiment of FIG. 1.

Reference is now made to FIG. 7, which illustrates highly schematically a cross-section of the hearing aid 100 according to the first embodiment of the invention. The cross-section is shown in a plane that is perpendicular to a general longitudinal axis of the housing, defined by the line connecting the first and second microphone inlet, and intersecting the first microphone inlet. The figure illustrates cross-sections of the hearing aid housing 101, the wind shield cover 102, the first microphone inlet 112 and the first microphone 121.

According to the first embodiment of the invention the hearing aid is designed such that the hearing aid housing 101 has a cross-section with a circumference in a plane perpendicular to a general longitudinal axis of the housing, defined by the line connecting the first and second microphone inlet, and a wind shield cover 102 that has a cross-section with a length, in said plane, when arranged on the housing, wherein the length of the wind shield cover cross-section is about 30% of the length of the housing circumference.

In variations of the first embodiment of the invention the length of the wind shield cover cross-section is at least 30% of the length of the housing circumference. Hereby a significant minimum distance along the gap can be obtained even for hearing aid housings with a relatively small housing circumference. In other variations of the first embodiment of the invention, the length of the wind shield cover cross-section is smaller than 30% of the length of the housing circumference. This type of wind shield covers are advantageous in the cases where relative short minimum distances along the gap are required in order to obtain a specific microphone frequency response.

According to the first embodiment of the invention the hearing aid housing consists of an upper and lower part that is fitted together.

According to another variation of the embodiment of the first invention the wind shield cover extends substantially all the way around the hearing aid housing except for a gap opening formed between the ends of the wind shield cover. According to a further variation the microphone inlets are positioned in the housing surface opposite the gap opening, hereby achieving, for a given hearing aid housing, the largest achievable minimum distance between the microphone inlet edges and the corresponding gap openings and according to a specific variation the gap opening is positioned in the upper surface of the hearing aid, i.e. the surface opposite the surface of the hearing aid housing that is adapted to rest upon the ear of the intended hearing aid user.

Figure 8:
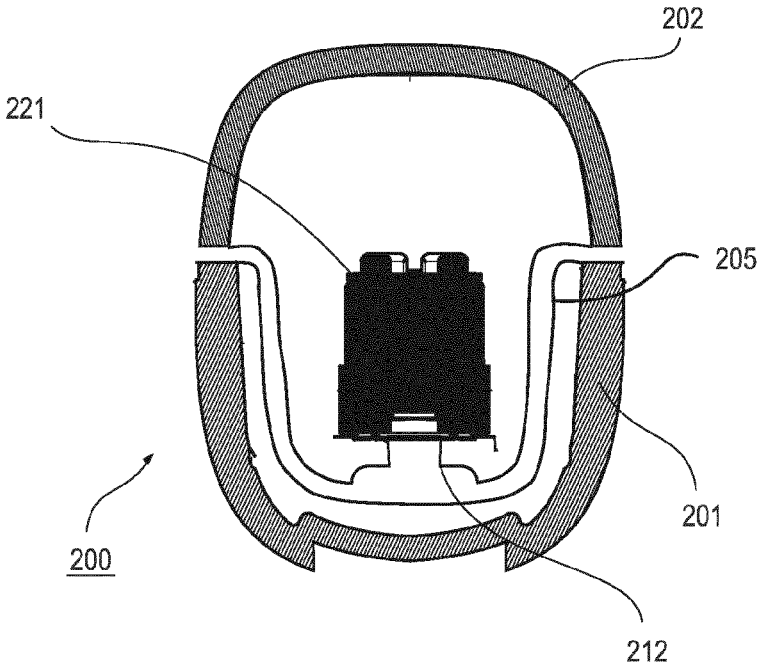
FIG. 8 illustrates highly schematically a cross-section of a hearing aid according to another embodiment of the invention.

Reference is now made to FIG. 8, which illustrates highly schematically a cross-section of a hearing aid 200 according to a second embodiment of the invention. The figure illustrates cross-sections of upper and lower hearing aid housing parts 201 and 202, a microphone inlet 212, a microphone 121 and a sound transmission channel 205. The sound transmission channel 205 provides for sound to be guided from the surroundings and to the microphone inlet 212. The sound transmission channel provides propagation of sound through the interior of the hearing aid housing as opposed to propagation in a gap between a wind shield cover and the outer surface of the hearing aid housing. Hereby the size of the hearing aid housing can be minimized because the wind shield cover is not required. Another advantageous aspect is that the sound transmission channel can be freely shaped, whereby the achievable minimum distance between the microphone inlets and the opening of the sound transmission channel can be increased. The sound transmission channel has a length of 1.5 mm and a cross-section having a first dimension of 0.3 mm and a second dimension of 5 mm.

According to variations of the second embodiment of the invention the sound transmission channel has a length of at least 1 mm, or a length in the range between 1 and 3 mm, the first dimension of the cross-section is in the range between 0.15 mm and 0.5 mm, preferably between 0.20 and 0.35 mm and the second dimension of the cross-section is at least 2 mm, at least 3 mm or at least 5 mm.

According to a further variation of the second embodiment of the invention the hearing aid comprises an insert that forms the sound transmission channel and further is adapted to position and hold the electronic components inside the hearing aid housing.

According to further variations of the first embodiment of the invention, the wind shield is provided with small holes just above the microphone inlets. Surprisingly this has been found to make the hearing aid microphones less sensitive to vibrations and hence feedback, while still providing good wind noise suppression. Holes with a diameter in the range between 0.15 mm and 0.30 mm have been found to be appropriate.

Other modifications and variations of the structures and procedures will be evident to those skilled in the art.

We claim:

1. A hearing aid comprising a microphone, a signal processing unit, an electrical-acoustical output transducer, a housing and a wind shield cover, wherein:

the housing has a surface with a microphone inlet, and the wind shield cover is adapted to be attached to the housing, whereby to cover the microphone inlet and to provide together with the housing a gap, said gap providing a conduit for the transmission of sound from the surroundings and to said microphone inlet, wherein the spacing between the housing and the wind shield cover is in the range between 0.15 mm and 0.5 mm, and wherein the minimum distance along the gap from the microphone inlet and to an edge of the wind shield cover is larger than 2 mm and less than 3 mm.

2. The hearing aid according to claim 1, wherein the wind shield cover is adapted such that sound is transmitted into the gap between the wind shield cover and the housing through an opening formed by the edge of the wind shield cover and the housing.

3. The hearing aid according claim 1, wherein the housing comprises distance holding means adapted for providing a support for the wind shield cover hereby securing a uniform spacing between the wind shield cover and the housing.

4. The hearing aid according claim 1, wherein the spacing between the housing and the wind shield cover is in the range between 0.20 mm and 0.35 mm.

5. The hearing aid according claim 1, wherein the width of the gap, at the edge of the wind shield cover, is at least 2 mm.

6. The hearing aid according claim 1, wherein the width of the gap, at the edge of the wind shield cover, is at least 3 mm.

7. The hearing aid according claim 1, wherein the width of the gap, at the edge of the wind shield cover, is at least 5 mm.

8. The hearing aid according claim 1, wherein the housing has a cross-section with a circumference in a plane, perpendicular to a general longitudinal axis of the housing defined by a line connecting the first microphone inlet and a second microphone inlet, and intersecting the microphone inlet, and the wind shield cover, when arranged on the housing, has in said plane a cross-section with a total length of more than 30% of the length of said first circumference.

9. The hearing aid according claim 1, wherein the wind shield cover extends substantially all the way around the hearing aid housing except for a gap opening formed between the ends of the wind shield cover.

10. A hearing aid adapted for suppression of wind noise comprising a microphone inlet, a housing, and a sound transmission channel adapted to provide for sound to be guided from the surroundings, through the interior of the housing and to the microphone inlet, wherein a first dimension of a cross-section of the sound transmission channel is in the range between 0.15 mm and 0.5 mm, a second dimension of the cross-section of the sound transmission channel is at least 2 mm, and the length of the sound transmission channel is larger than 2 mm and less than 3 mm.

11. The hearing aid according to claim 10, wherein the first dimension of a cross-section of the sound transmission channel is in the range between 0.20 mm and 0.35 mm.

12. The hearing aid according to claim 10, wherein the second dimension of the cross-section of the sound transmission channel is at least 5 mm.

13. The hearing aid according to claim 10, wherein the sound transmission channel is formed as part of an insert adapted for accommodating electronic components inside the hearing aid housing.

14. The hearing aid according to claim 10, wherein the sound transmission channel comprises at least one bend arranged for increasing the length of the sound transmission channel.

15. A hearing aid comprising a microphone, a signal processing unit, an electrical-acoustical output transducer, a housing and a wind shield cover, wherein:

the housing has a surface with a microphone inlet, and the wind shield cover is adapted to be attached to the housing, to cover the microphone inlet, to provide together with the housing a gap, the gap providing a conduit for the transmission of sound from the surroundings and to said microphone inlet, wherein the spacing between the housing and the wind shield cover is in the range between 0.15 mm and 0.5 mm, and wherein the minimum distance along the gap from the microphone inlet and to an edge of the wind shield cover, is at least 3 mm.

16. The hearing aid according to claim 15, wherein the wind shield cover is adapted such that sound is transmitted into the gap between the wind shield cover and the housing through an opening formed by the edge of the wind shield cover and the housing.

17. The hearing aid according claim 15, wherein the housing comprises distance holding means adapted for providing a support for the wind shield cover hereby securing a uniform spacing between the wind shield cover and the housing.

18. The hearing aid according claim 15, wherein the minimum distance along the gap from the microphone inlet and to an edge of the wind shield cover is at least 4 mm.

19. The hearing aid according claim 15, wherein the spacing between the housing and the wind shield cover is in the range between 0.20 mm and 0.35 mm.

20. A hearing aid adapted for suppression of wind noise comprising a microphone inlet, and a sound transmission channel adapted to provide for sound to be guided from the surroundings and to the microphone inlet, wherein a first dimension of a cross-section of the sound transmission channel is in the range between 0.15 mm and 0.5 mm, and a second dimension of a cross-section of the sound transmission channel, is at least 3 mm, and the length of the sound transmission channel is at least 3 mm.

21. The hearing aid according to claim 2, wherein said opening is formed at an outer peripheral edge of said wind shield cover.

22. The hearing aid according to claim 10, wherein said length of said sound transmission channel is the shortest distance from any edge of said microphone inlet to an opening, to the surroundings, defined by said housing and an outer peripheral edge of a wind shield cover.

23. The hearing aid according to claim 16, wherein said edge of the wind shield cover is an outer peripheral edge of said wind shield cover.

24. The hearing aid according to claim 20, wherein said length of said sound transmission channel is the shortest distance from any edge of said microphone inlet to an opening, to the surroundings, defined by said housing and an outer peripheral edge of a wind shield cover.

* * * * *